United States Patent [19]

LaForge

[11] Patent Number: 4,643,164

[45] Date of Patent: Feb. 17, 1987

[54] PORTABLE STOVE ASSEMBLY

[75] Inventor: Laurence E. LaForge, Northboro, Mass.

[73] Assignee: Environments, Limited, Montreal, Canada

[21] Appl. No.: 821,756

[22] Filed: Jan. 23, 1986

[51] Int. Cl.[4] ..... F41F 9/00

[52] U.S. Cl. ..... 126/44; 126/38; 431/344; 222/401

[58] Field of Search ..... 126/38, 42, 44, 59.5, 126/40; 431/344; 222/209, 400.5, 401, 3; 137/209

[56] References Cited

U.S. PATENT DOCUMENTS

| | | | |
|---|---|---|---|
| 585,641 | 6/1897 | Dupee . | |
| 1,160,894 | 11/1915 | High et al. . | |
| 1,341,046 | 5/1920 | Davidson et al. . | |
| 1,345,065 | 9/1920 | Pruessing et al. . | |
| 1,887,855 | 11/1932 | Leety et al. | 431/227 |
| 2,465,572 | 3/1949 | Bramming | 431/344 |
| 2,469,185 | 5/1949 | Tullis | 126/44 |
| 2,538,538 | 1/1951 | Stempel et al. | 126/38 |
| 3,213,848 | 10/1965 | Wei | 126/44 X |
| 3,361,298 | 1/1968 | Trumble | 431/344 X |
| 3,900,281 | 8/1975 | Penberthy | 431/344 |
| 3,902,517 | 9/1975 | Hastwell | 431/344 X |

*Primary Examiner*—Margaret A. Focarino

*Attorney, Agent, or Firm*—Blodgett & Blodgett

[57] ABSTRACT

A portable stove assembly comprising a support member having a side wall which has at least one opening, a stove for burning liquid fuel which is located within the support member and which includes a fuel reservoir, and an air pressure assembly for pressurizing the fuel reservoir of the stove. The stove includes an inlet fixture for a closure cap and an air pressure assembly includes and elongated connecting tube with a cap at one end for engaging the inlet fixture on the stove and a gas fixture at the opposite end for receiving a portable air pump. The connecting tube is configured to extend through the opening of the support member when the cap is applied to the inlet fixture so that the gas fixture is located outside of the support member.

8 Claims, 6 Drawing Figures

PORTABLE STOVE ASSEMBLY

BACKGROUND OF THE INVENTION

The present invention is generally directed to a portable stove assembly which is used for hiking, camping, hunting, or other outdoor activities. The invention is particularly directed to a portable stove assembly which includes a stove which utilizes a liquid fuel and which is capable of being pressurized by a portable air pump.

The prior art portable stove assembly includes a camping stove which is enclosed within a pot-shaped support member for supporting a cooking pot. The support member has a bottom wall and an apertured vertical side wall. The side wall functions as a wind shield while the apertures in the side wall provide drafting to support combustion for the cooking stove. The stove includes a fuel reservoir, a tube which extends upwardly from the reservoir, and a burner unit which is attached to the top of the tube. In some cases, the burner extends above the top of the support member so that a secondary support member is used. The secondary support member is adapted to be supported on the primary support member and, in turn, supports the cooking pot. The secondary support member has a bottom wall which includes a central aperture for receiving the burner portion of the stove. The stove also includes an inlet fixture having an inlet opening for introduction of fuel. The fixture is adapted to receive a fill cap. The traditional cooking stove is provided with a shallow depression at the base of the burner tube. The method of starting this stove is to place a certain amount of fuel in the depression at the top of the reservoir. The fuel in the depression is then ignited with a match which causes the tank to be heated. When the tank is heated sufficiently, the inside of the tank becomes pressurized and causes the fuel within the tank to become vaporized. A flame nozzle which extends from the burner tube is then opened to release vaporized fuel at the burner which is then ignited. As long as there is a flame within the burner, the reservoir stays heated and pressurized. However, under certain conditions, as, for example, a cold windy day, the reservoir becomes sufficiently cooled to become depressurized. This occurs in spite of the continuous burning in the burner unit. When the reservoir becomes depressurized, the flame in the burner goes out. In an effort to solve this problem, a fill cap was developed for the inlet fixture which also has a fixture for receiving a small hand pump for pressurizing the fuel reservoir. This fill cap works quite satisfactorily for the initial pressurizing of the fuel reservoir. However, if the flame within the burner unit goes out when the stove is in use, the cooking pot has to be removed and a supporting member or members have to be dissembled in order for the fuel reservoir to be pressurized by the hand pump. If this occurs in the middle of the cooking operation, it is a source of major aggravation to the camper or hiker. A place has to be found for all of the dissembled parts of the cooking assembly and the cooking pot has a chance to cool off by the time all of the elements are dissembled and reassembled and cooking is resumed. These and other difficulties experienced with the prior art devices have been obviated in a novel manner by the present invention.

It is, therefore, a principle object of the invention to provide a portable stove assembly which enables the fuel reservoir of the stove to be pressurized without dissembling all of the elements of the cooking assembly.

Another object of this invention is the provision of a portable stove assembly which includes an air pressure assembly which enables the stove to be pressurized by a hand pump from outside of the assembly.

A further object of the present invention is the provision of a portable stove assembly which includes an air pressure assembly that extends through one of the apertures in the support member so that it is accessible from outside of the assembly.

It is another object of the present invention to provide an air pressure assembly for a portable stove assembly which is adapted to be attached at one end to the inlet fixture of the conventional stove and which has at its opposite end a gas fixture for receiving a portable air pump outside of the portable stove assembly.

A still further object of the invention is the provision of an air pressure assembly which is adapted to be attached to the inlet fixture of the stove and which enables the stove to be pressurized from outside of the portable stove assembly.

It is a further object of the invention to provide an air pressure assembly for a portable stove which enables the stove to be filled with liquid fuel and pressurized from outside of the portable stove assembly.

It is a further object of the invention to provide an air pressure assembly which is simple in construction, which is inexpensive to manufacture and which is easy to use by a camper or hiker.

With these and other objects in view, as will be apparent to those skilled in the art, the invention resides in the combination of parts set forth in the specification and covered by the claims appended hereto.

SUMMARY OF THE INVENTION

The invention consists of a portable stove assembly having a support member for a cooking pot and which includes an apertured side wall, a stove for burning liquid fuel, the stove including a fuel reservoir, and an air pressure assembly having an elongated connecting tube; a cap at one end of the tube which is adapted to engage an inlet fixture of a stove; and a gas fixture at the opposite end for receiving a portable air pump. The tube is configured so that when the air pressure assembly is attached to the fuel reservoir, the tube extends through one of the apertures in the side wall of a support member, so that the gas fixture is located outside of the support member. The invention also consists of an air pressure assembly for a portable stove as described above.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
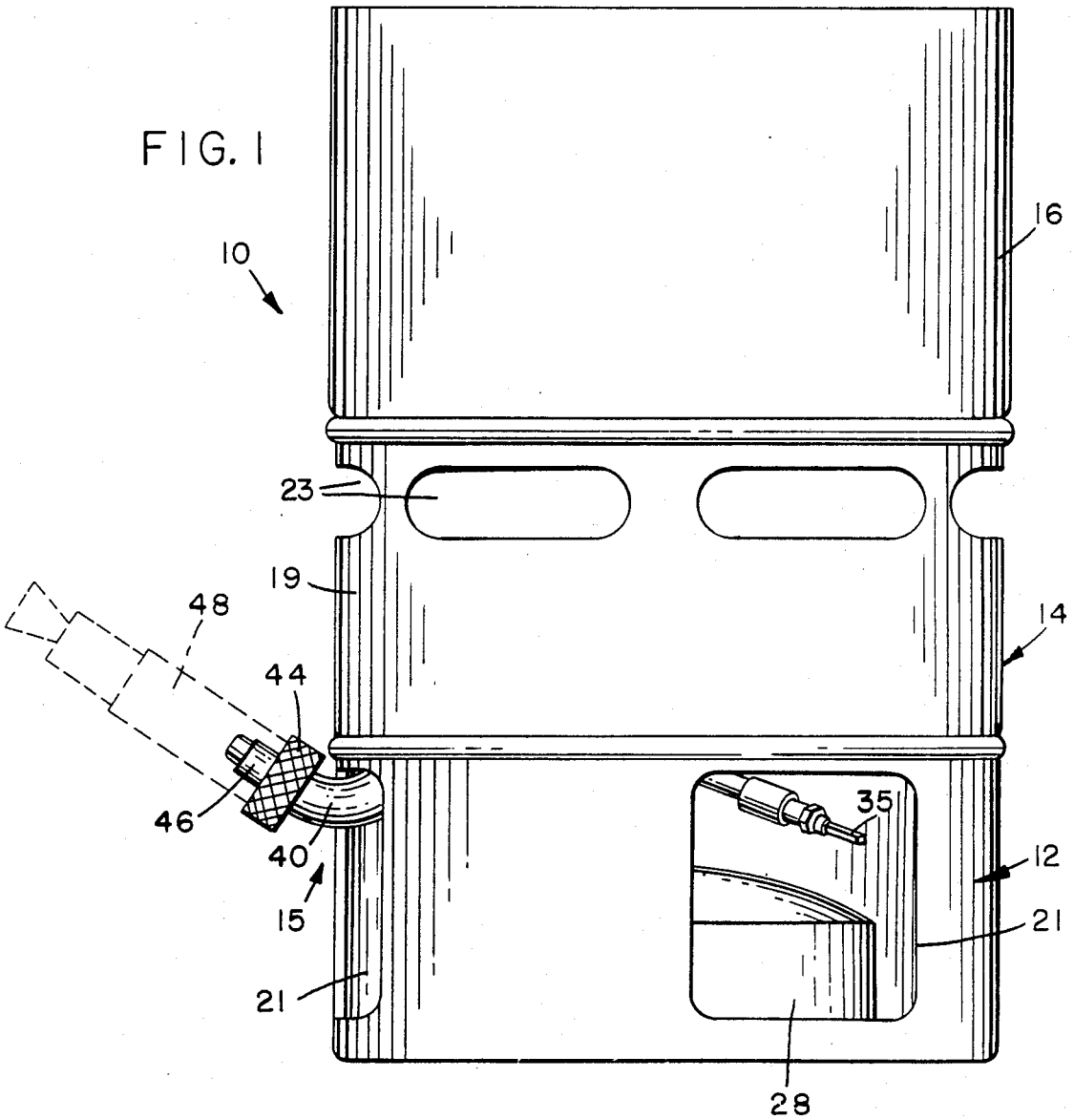
FIG. 1 is a front elevational view of a portable stove assembly embodying the principles of the present invention.
Figure 2:
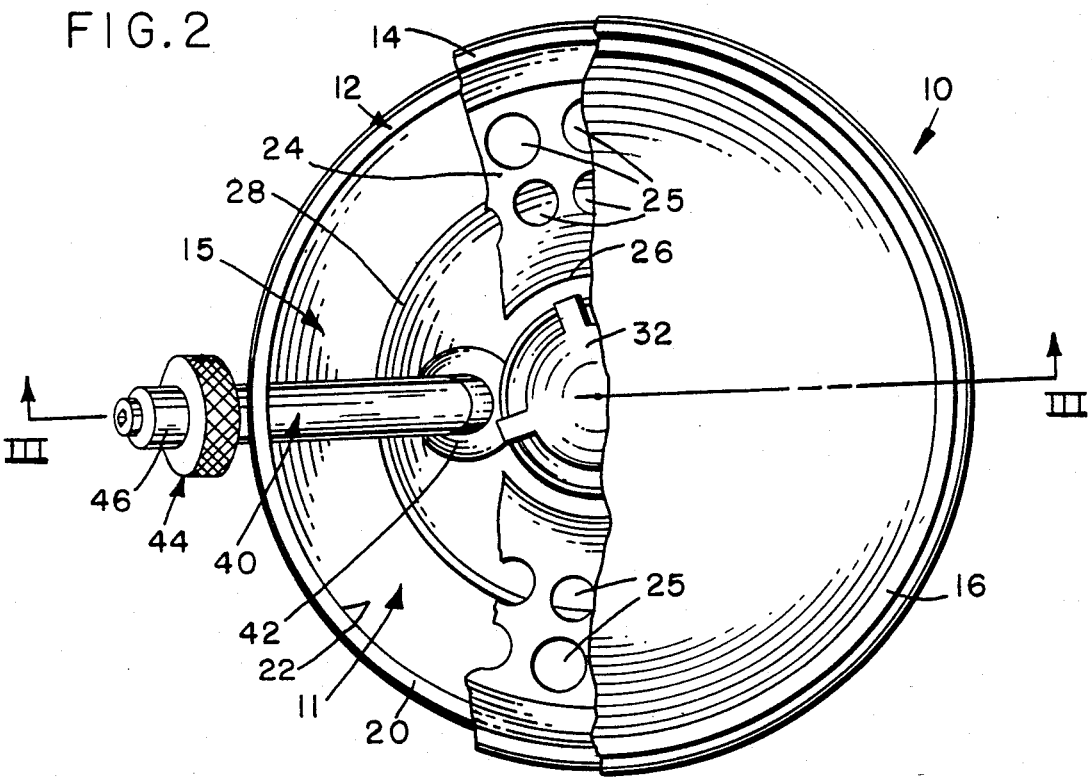
FIG. 2 is a plan view of the portable stove assembly with portions broken away.
Figure 3:
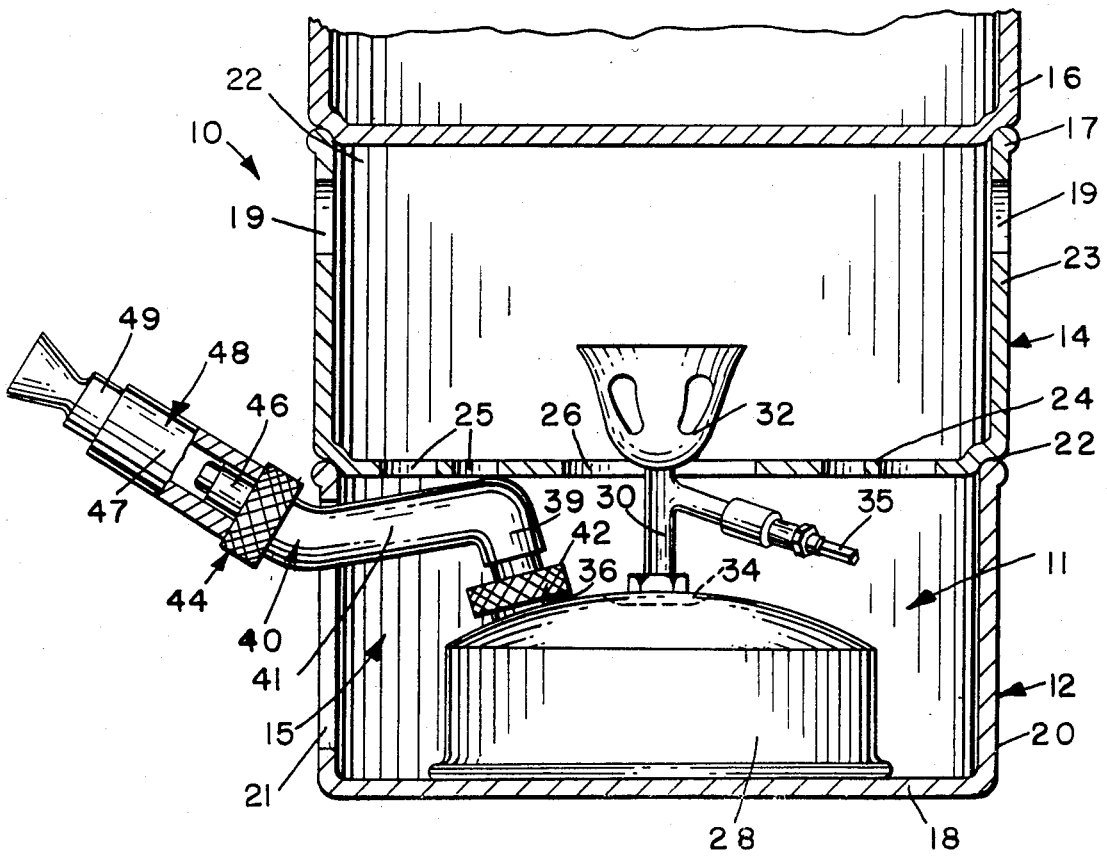
FIG. 3 is a vertical cross-sectional view of the portable stove assembly taken along the line III—III of FIG. 2.

Referring first to FIGS. 1–3, the portable stove assembly of the present invention is generally indicated by the reference numeral 10 and includes a cooking stove which is generally indicated by the reference numeral 11, a primary support member generally indicated by the reference numeral 12, a secondary support member 14, generally indicated by the reference numeral, and an air pressure assembly, generally indicated by the reference numeral 15. The primary support member 12 includes a bottom wall 18 and an annular vertical side wall 20 which extends upwardly from the bottom wall 18. The side wall 20 has three apertures, two of which are shown in FIG. 1 at 21 and 21'. The top edge of the side wall 20 defines a top opening 22 and is adapted to support the secondary support member 14. The secondary support member 14 also includes an annular side wall 19 which has a plurality of apertures 23. The top edge of wall 19 defines a top opening 17 and is adapted to support a cooking pot 16. The secondary support member 14 also includes a bottom wall 24 which is provided with a plurality of relatively small apertures 25 and a relatively large central aperture 26.

The cooking stove 11 includes a tank-shaped reservoir 28, a burner tube 30 which extends vertically from the top of the reservoir 28 and a burner or nozzle 32 which is attached to the top of the burner tube 30. The top of the reservoir 28 has a depression 34 at the base of the burner tube 30. A valve stem 35 extends from the burner tube 30 for opening a valve within the burner tube 30 for releasing pressurized fuel vapor to the burner 32. The stove 11 is adapted to be located primarily within the primary support member 12 so that the burner or nozzle 32 extends through the central opening 26 of the secondary support member 14. The reservoir 28 is also provided with an inlet fixture 36 which consists of a tubular projection with external threads. The inlet fixture 36 is adapted to receive a threaded fill cap.

Figure 4:
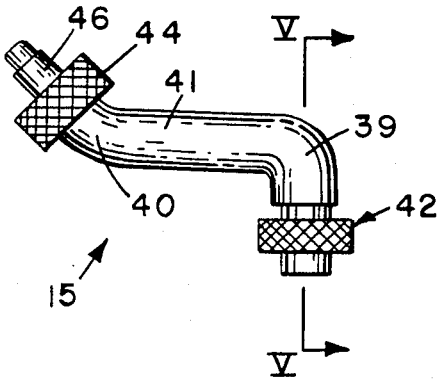
FIG. 4 is a front elevational view of an air pressure assembly embodying the principles of the present invention.
Figure 5:
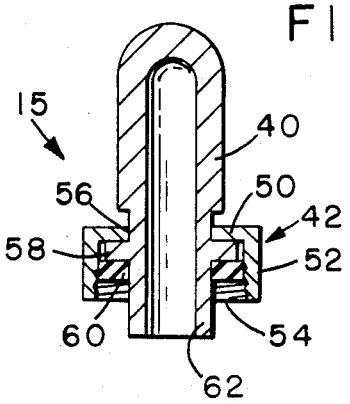
FIG. 5 is a vertical cross-sectional view of the air pressure assembly taken along the line V—V of FIG. 4.

Referring also to FIGS. 4 and 5, the air pressure assembly 15 includes an elongated connecting tube 40, a cap 42 which is operatively connected to one end of the tube and a gas fixture, generally indicated by the reference numeral 44 which is operatively connected to the opposite end of the tube. The gas fixture 44 includes a nipple 46 and a one-way valve which permits air flow only towards the cap 42. The nipple 46 is adapted to receive the end of a conventional hand-operated air pump 48. The air pump 40 includes a cylinder 47 and a piston 49 which is slidably mounted within the cylinder 47. The particular hand pump which is used with this invention is an optimus mini pump which is manufactured by Optimus Princess Inc. of Santa Fe Springs, Calif. The gas fixture 44 is configured to mate with this pump. The elongated connecting tube 40 is configured to extend through the aperture 21 when the cap 42 is attached to the inlet fixture 36 so that the gas fixture 44 is located outside of the primary support member 12 as shown in FIGS. 1–3. When the cap 42 is attached to the inlet fixture 36, the adjacent portion of the tube 40 which is indicated at 39 extends substantially vertically. The remaining portion of the tube 40 which is indicated at 41 extends substantially horizontally.

Referring particularly to FIG. 5, the cap 42 comprises an end wall 50 and an annular side wall 52 which extends from the end wall 50 and terminates in an end opening 54. The inside surface of the side wall 52 is provided with threads for engaging the external threads of the inlet fixture 36. The end wall 50 has a central opening 56 through which the tube 40 extends, so that the cap 42 is free to rotate about the central longitudinal axis of the substantially vertical portion 39 of the tube 40. The tube 40 has an outer annular flange 58 which is located between the end wall 50 and the opening 54. An elastomeric sealing washer 60 is located between the flange 58 and the opening 54. When the cap 42 is applied to the inlet fixture 36, the open end 62 of the tube 40 extends into the inlet fixture 36 and the cap 52 is threaded onto the inlet fixture 36 by rotating the cap 42 relative to the tube 40. As the cap 42 is tightened, the top edge of the inlet fixture 36 engages the washer 60 which is compressed between the inlet fixture 36 and the flange 58 to provide a gas seal between the cap 42 and the inlet fixture 36.

The operation and advantages of the present invention will now be readily understood in view of the above description.

The portable stove assembly 10 of the present invention is utilized by first placing the stove 11 within the primary support member 12 and, preferably, positioning the stove so that the valve stem 35 is accessible from one of the apertures in the primary support member, as for example aperture 21' as shown in FIG. 1. The stove 11 is provided with a key, not shown, which can be inserted through the aperture 21' for engaging the valve stem 35 for releasing fuel vapor to the burner 32. The air pressure assembly 15 is positioned on the burner 11 so that the cap 42 engages the inlet fixture 36 and the connecting tube 40 extends through the aperture 21 so that the gas fixture 44 extends outside of the primary support member 12. The cap 42 is screwed onto the inlet fixture 36. When the cap 42 is applied to the fixture 36, the portion 39 of the tube 40 extends primarily vertically to a point just below the top edge of the wall 20 and the portion 41 is predominatly horizontal so that it extends through the aperture 21. Since the cap 42 can be rotated relative to the tube 40, the tube 40 can be positioned so that it extends through one of the apertures (aperture 21) in the primary support member and the stem 35 can be aligned with one of the other apertures, (aperture 21') while the cap 42 is tightened onto the inlet fixture 36. For example, in the primary support member 12 which is illustrated in FIG. 1, there are three apertures spaced 120° apart. The connecting tubes 40 and valve stem 35 can be positioned so that they are 120° apart relative to the central vertical axis of the stove 11 so that the connecting tube 40 and the stem 35 are aligned with the apertures 21 and 21', respectively. The relative positions of the tube 40 and the valve stem 35 can be maintained while the cap 42 is fully tightened onto the fixture 36. The position of the tube 40 relative to the valve stem 35 can be adjusted to correspond to a primary support member having apertures which are located less than 120° or more than 120° from each other.

When the cap 42 is fully tightened onto the inlet fixture 36, the secondary supporting member 14 is positioned on top of the primary supporting member 12 and the cooking pot 16 is positioned on top of the secondary support member 14, as shown in FIGS. 1 and 3. Assuming that the reservoir 28 of the stove 11 contains fuel, the stove 11 is now ready for lighting. The pump 48 is applied to the nipple 46 and the piston 49 is reciprocated within the cylinder 47 for pressurizing the reservoir 28. The pump 48 is then removed from the nipple 46 and the valve within the tube 30 is opened by rotating the valve stem 35 by an appropriate valve key, not shown. This releases fuel vapor into the burner 32 and the vapor is ignited with a match. The cooking pot 16 is then placed on top of the secondary support member 14 for cooking. Normally, the reservoir 28 remains pressurized from the heat which is generated by the burner 32 so that fuel vapor feeds continuously to the burner 32 to sustain combustion. If, however, the flame within the burner 32 is extinguished due to exceptionally windy conditions or extreme cold which lowers the temperature of the reservoir 28, the stove can be restarted by applying the pump 48 to the nipple 46 thereby re-pressurizing the reservoir 28. The burner 32 can be ignited by removing the cooking pot 16 and applying a match to the burner 32 or by inserting the match through one of the apertures 23 in the side wall 19 of the secondary support member 14. The versatility of the air pressure assembly 15 enables it to be applied to any portable stove assembly which includes a stove having an inlet fixture and a support member which has at least one aperture in the side wall.

MODIFIED AIR PRESSURE ASSSEMBLY

Figure 6:
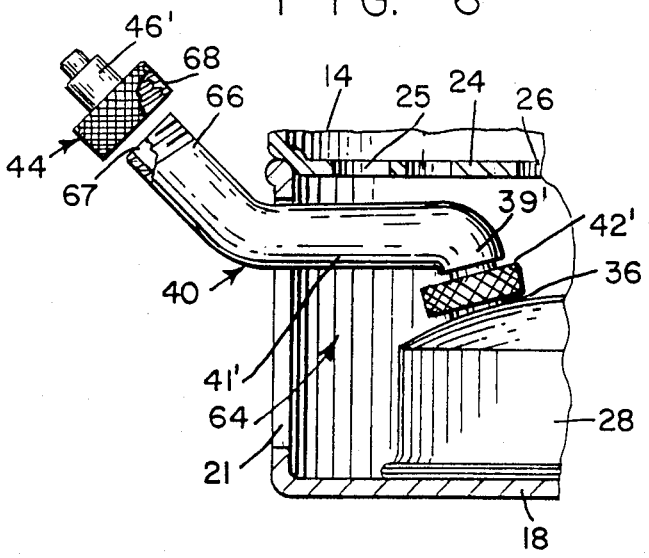
FIG. 6 is a front elevational view of a modified air pressure assembly, shown applied to a portable stove.

Referring to FIG. 6, there is shown a modified air pressure assembly which is generally indicated by the reference numeral 64. Air pressure assembly 64 is shown operatively attached to the inlet fixture 36 of the fuel reservoir 28.

The air pressure assembly 64 includes an elongated connecting tube 40' and a cap 42' which is operatively connected to one end 39' of the tube 40'. The opposite end of the tube 40' is indicated by the reference numeral 66, has an end opening 67 and a threaded outer surface. A gas fixture 44' includes an annular flange 68 which has an inner threaded surface and a nipple 46'. The nipple 46' is adapted to receive the hand pump 48 and the flange 68 enables the gas fixture 44' to be screwed onto the threaded end 66 of the tube 40'. The ends 66 and 39 of the tube 40 are connected by a substantially straight portion 41'. When the cap 42' is applied to the inlet fixture 36 as shown in FIG. 6, the straight portion 41' extends substantially horizontally through the aperture 21 of the primary support member 12. The end 66 of the tube 40' extends at an angle to the portion 41' so that when the cap 42' is applied to the fixture 36, the end 46 extends outwardly from the aperture 21 at an upward angle. The threaded end 66 is adapted to receive a fill cap or the gas fixture 44 for enabling the reservoir 28 to be pressurized by the air pump 48. The end opening 67 is adapted for receiving a fill funnel for supplying liquid fuel to the reservoir 28. The end opening 67 is located at a sufficient distance above the rest of the connecting tube 40' to enable liquid fuel to flow from the opening 67 and through the tube 40' into the reservoir 28. The cap 42' is connected to the end 39' in the same manner as cap 39 is connected to the portion 39 of the tube 40.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Portable stove assembly comprising:

(a) a support member for a cooking utensil, said support member having a bottom wall and a continuous side wall extending vertically from the bottom wall, said side wall having at least one aperture, (b) a stove for burning liquid fuel, said stove being freely supported on said bottom wall within the side wall of the support member and having a fuel reservoir, a tube which extends upwardly from the reservoir, a burner unit which is attached to the top of the tube, an inlet fixture at the top of the reservoir which comprises a tubular projection with external threads for receiving a fill cap having internal threads, said fixture having an inlet opening to the reservoir for filling the reservoir with fuel, and (c) an air pressure assembly comprising:

(1) a cap which has an end wall, a central opening in said end wall, an annular side wall extending from said end wall and having an open end and internal threads for enabling the cap to be threaded onto said inlet fixture, (2) an elongated connecting tube, one end of which has an opening and extends through said central opening so that said cap is free to rotate relative to said connecting tube, said connecting tube having an outer annular flange which is located between said end wall and the open end of said cap, (3) an elastomeric sealing washer between the flange and said open end for engaging the end of said tubular projection and for being forced against said flange by said tubular projection when the cap is threaded onto the threaded projection to form a gas seal between the cap and said tubular projection, and (4) a gas fixture which is operatively connected to the opposite end of said connecting tube and which is adapted for operatively receiving a portable air pump, said connecting tube being configured so that when said cap is attached to said inlet fixture, the connecting tube extends through said aperture so that said gas fixture tube lies outside of the side wall of said support member.

2. Portable stove assembly as recited in claim 1, wherein said gas fixture has a one way valve which allows air to flow only from the gas fixture to the connecting tube.

3. Portable stove assembly as recited in claim 1, wherein when said air pressure assembly is attached to said inlet fixture, said one end of the connecting tube has a substantially vertical orientation and the remainder of the connecting tube has a predominantly horizontal orientation.

4. Portable stove assembly as recited in claim 1, wherein said gas fixture is removably attached to the opposite end of said connecting tube.

5. Air pressure assembly for a portable stove assembly having a support member which includes a bottom wall and a continuous side wall with at least one aperture, and a stove for burning liquid fuel being freely supported on said bottom wall within the side wall of the support member and having a fill cap having internal threads, said fixture having an inlet opening to the reservoir for filling the reservoir with fuel, said air pressure assembly comprising:

(a) a cap which has an end wall, a central opening in said end wall, an annular side wall extending from said end wall and having an open end and internal threads for enabling the cap to be threaded onto said inlet fixture, (b) an elongated connecting tube, one end of which has an opening and extends through said central opening so that said cap is free to rotate relative to said connecting tube, said connecting tube having an outer annular flange which is located between said end wall and the open end of said cap, (c) an elastomeric sealing washer between the flange and said open end for engaging the end of said tubular projection and for being forced against said flange by said tubular projection when the cap is threaded onto the threaded projection to form a gas seal between the cap and said tubular projection, and (d) a gas fixture which is operatively connected to the opposite end of said connecting tube and which is adapted for operatively receiving a portable air pump, said connecting tube being configured so that when said cap is attached to said inlet fixture, the connecting tube extends through said aperture so that said gas fixture tube lies outside of the side wall of said support member.

6. Air pressure assembly as recited in claim 5, wherein said gas fixture has a one way valve which allows air to flow only from the gas fixture to the connecting tube.

7. Air pressure assembly as recited in claim 5, wherein said gas fixture is removably attached to the opposite end of said connecting tube.

8. Air pressure assembly as recited in claim 7, wherein said gas fixture has an annular flange with internal threads and the opposite end of said connecting tube has external threads for receiving the annular threaded flange of said gas fixture.

* * * * *